US005761756A

United States Patent [19]

Nowak et al.

[11] Patent Number: 5,761,756

[45] Date of Patent: Jun. 9, 1998

[54] PORTABLE BED RAIL

[75] Inventors: Ralph M. Nowak, Marblehead; John B. Morse, Boston, both of Mass.

[73] Assignee: The First Years Inc., Avon, Mass.

[21] Appl. No.: 739,113

[22] Filed: Oct. 25, 1996

[51] Int. Cl.[6] ..... A47D 21/08

[52] U.S. Cl. ..... 5/426; 5/430; 403/102; 403/3

[58] Field of Search ..... 5/426, 430, 428, 5/425; 403/3, 102

[56] References Cited

U.S. PATENT DOCUMENTS

| | | | |
|---|---|---|---|
| 329,663 | 11/1885 | McMurray . | |
| 2,048,955 | 7/1936 | Showalter | 5/94 |
| 2,611,909 | 9/1952 | Dillon et al. . | |
| 2,751,608 | 6/1956 | Lucas . | |
| 4,178,645 | 12/1979 | Cosme | 5/426 |
| 4,370,765 | 2/1983 | Webber . | |
| 4,827,545 | 5/1989 | Arp . | |
| 4,833,743 | 5/1989 | Howell et al. | 5/426 |
| 5,437,067 | 8/1995 | Bernstein et al. | 5/426 |
| 5,577,277 | 11/1996 | Sundberg et al. | 5/426 |
| 5,640,726 | 6/1997 | Fichner-Rathus | 5/426 |

FOREIGN PATENT DOCUMENTS 2225716 6/1990 United Kingdom .

*Primary Examiner*—Alexander Grosz
*Attorney, Agent, or Firm*—Fish & Richardson P.C.

[57] ABSTRACT

A portable bed rail is provided including first and second foot members, each having a first end dimensioned for insertion under a mattress and a second end spaced from said first end, and a side panel positioned to provide a barrier to falling from the bed. The side panel includes first and second vertical members extending upwardly from the second ends of the foot members, first and second spaced horizontal rails extending between the vertical members to define a frame, each of the rails having a first and second end, which ends are received by the first and second vertical members, and a flexible cover removably mounted on the frame. The flexible cover is dimensioned to extend around the first and second ends of the horizontal rails and thereby retain the ends in engagement with the first and second vertical members.

16 Claims, 7 Drawing Sheets

PORTABLE BED RAIL

BACKGROUND OF THE INVENTION

The present invention relates to bed rails provided to prevent an individual, particularly a small child, from falling out of bed.

It has long been known to removably attach devices commonly referred to as "bed rails" or "safety side rails" to beds in order to prevent the occupant of the bed, typically a small child, from accidentally rolling off of the mattress. These bed rails generally include a pair of spaced, substantially parallel horizontal foot members, dimensioned so that a major portion of each foot member may be inserted under a side edge of the mattress, and a side panel comprised of vertical members extending upwardly from the foot members and at least a pair of spaced horizontal rails extending between the vertical members. The side panel is positioned to provide a barrier to falling from the bed and often includes a cloth cover to assist in providing the barrier and/or to provide a soft surface for the occupant to contact. It is also common for the side panel to be mounted pivotably to the foot members so that an adult can move the bed rail to a lowered position to obtain access to the child in the bed and so that when the bed rail is not in use it can be folded flat for storage. While this is a useful feature, it is sometimes possible for a child to raise and lower the bed rail, potentially resulting in injury to the child.

SUMMARY OF THE INVENTION

The invention features an improved portable bed rail which is easily and quickly assembled and disassembled, and which is easy to clean and repair. In preferred embodiments, the bed rail also includes an improved pivotable coupling that is capable of securely locking the bed rail in both its raised and lowered positions in a manner that tends to prevent children from raising and lowering the bed rail.

In one aspect, the portable bed rail includes first and second foot members, each having a first end dimensioned for insertion under a mattress and a second end spaced from the first end, and a side panel positioned to provide a barrier to falling from the bed. The side panel includes first and second vertical members extending upwardly from the second ends of the foot members, first and second spaced horizontal rails extending between the vertical members to define a frame, each of the rails having a first and second end, which ends are received by the first and second vertical members, and a flexible cover removably mounted on the frame. The flexible cover is dimensioned to extend around the first and second ends of the horizontal rails and thereby retain the ends in engagement with the first and second vertical members.

Preferably, the flexible cover includes first and second elongated pockets dimensioned to receive the first and second horizontal rails. The flexible cover also preferably includes first and second end portions positioned at opposite ends of the elongated pockets, each end portion comprising a pair of flaps dimensioned to surround the corresponding vertical member and thereby retain the ends of the horizontal rails in engagement with the vertical members, and a fastener positioned to fasten each flap in position around the vertical member.

Advantageously, the portable bed rail can be easily disassembled simply by removing the cover and disengaging the horizontal rails from the vertical members. In a particularly preferred embodiment, the vertical members are pivotably mounted on the foot members, allowing the disassembled bed rail to be folded flat for transport and storage.

In another aspect, the portable bed rail includes first and second foot members, each having a first end dimensioned for insertion under a mattress and a second end spaced from the first end, a side panel positioned to provide a barrier from falling from the bed, the side panel including first and second vertical members extending upwardly from the second ends of the foot members, and a pair of pivotable couplings, one pivotable coupling being interposed between a lower end of the first vertical member and the second end of the foot member from which the vertical member extends, and the other pivotable coupling being interposed between a lower end of the second vertical member and the second end of the foot member from which the vertical member extends. The pivotable coupling is constructed to allow the vertical member to be rotated between a raised position, in which it extends upwardly substantially perpendicular to the foot member, and a lowered position, in which it extends downwardly substantially perpendicular to the foot member, and to be locked in both its raised and lowered positions.

Preferably, the pivotable coupling includes a stationary coupling member from which the foot member extends in a manner to resist relative rotation of the foot member with respect to the coupling member. The vertical member is pivotably mounted on the coupling member and the vertical member and coupling member include first interlocking portions that engage when the vertical members are in the raised position and second interlocking portions that engage when the vertical members are in the lowered position. Each of the first and second interlocking portions are constructed to be disengaged only by movement of the vertical member in a direction other than rotation, preferably by combined upward and outward movement for the first interlocking portions, and by upward movement for the second interlocking portion.

In one embodiment, the first interlocking portions comprise (a) a recess in an upper surface of the coupling member, the recess having a lip extending along one of its longitudinal edges, the opposite edge being smooth, and (b) a latch member on the vertical member dimensioned to be received by the recess and having a portion dimensioned to engage the opening of the recess in an interference fit when the vertical member is in its raised position. Preferably, the interference fit is disengageable by moving the vertical member directly upward, and the vertical member includes a shoulder positioned to engage the lip when the raised vertical member is pulled directly upward, and an inclined surface positioned and dimensioned to allow the shoulder to be disengaged from the lip by pulling outward on the vertical member to slide the inclined surface over the smooth edge of the recess. The second interlocking portions comprise (a) a cavity in the coupling member dimensioned to receive a second latch member on the vertical member, the cavity including a stop, and (b) a second latch member on the vertical member having a shoulder dimensioned to engage the stop when the vertical member is in its lowered position, to resist rotation toward the raised position. Preferably the engagement of the shoulder with the stop is disengageable by moving the vertical member upward relative to the coupling member, and the second latch member and cavity are constructed to allow the vertical member to be rotated about the longitudinal axis of the second latch member when the shoulder and stop are disengaged.

Other features and advantages of the invention will be apparent from the description of preferred embodiments thereof, taken together with the drawings, and from the claims.

DESCRIPTION OF THE PREFERRED EMBODIMENTS

Figure 1:
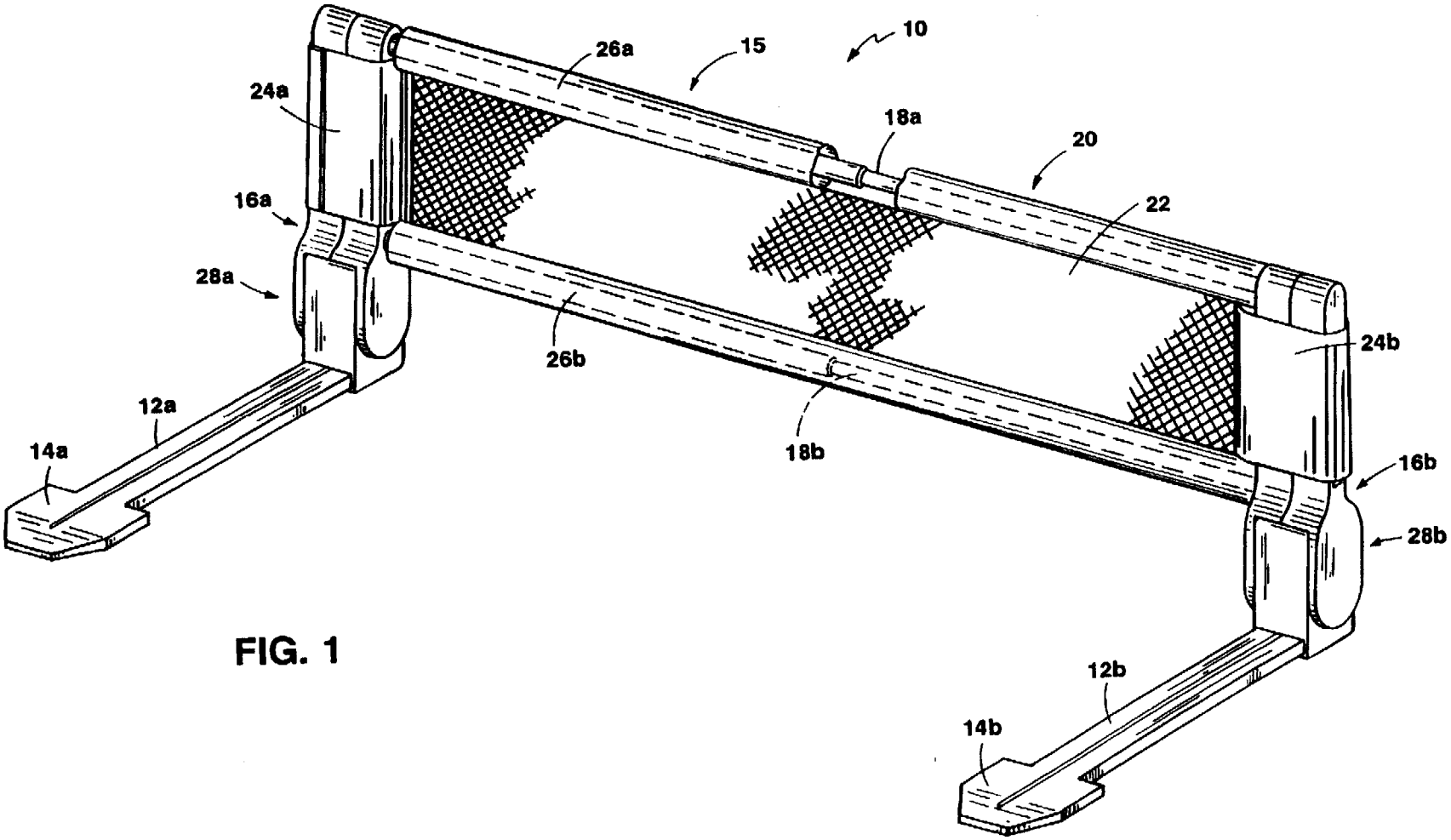
FIG. 1 is a perspective view of a bed rail according to one embodiment of the invention.

As shown in FIG. 1, a preferred portable bed rail 10 includes first and second horizontal foot members 12*a*, 12*b*, each having a tapered portion 14*a*, 14*b* to allow the foot members to easily slide under a mattress, and a side panel 15 which includes first and second vertical members 16*a*, 16*b*, and horizontal rails 18*a*, 18*b*. Vertical members 16*a*, 16*b* are pivotally attached to horizontal foot members 12*a*, 12*b* at pivotable couplings 28*a*, 28*b*, as will be described in further detail hereinbelow.

The portable bed rail 10 further includes a cloth cover 20. Cloth cover 20 includes a mesh portion 22, which forms a barrier to prevent the occupant of the bed from falling, end portions 24*a* and 24*b* which wrap around the vertical members 16*a*, 16*b* and connect the cloth cover thereto, and pockets 26*a* and 26*b* in which horizontal rails 18*a* and 18*b* are removably retained. Horizontal rails 18*a*, 18*b* are removably retained in apertures 32*a*, 32*b* (FIG. 2) by the end portions of the cloth cover when the bed rail is assembled. For ease of assembly and disassembly, the horizontal rails 18*a*, 18*b* preferably fit loosely into apertures 32*a*, 32*b* of vertical members 16*a* and 16*b*, respectively, and, but for the end portions 24*a*, 24*b* of cover 20, would fall out of the apertures.

Figure 2:
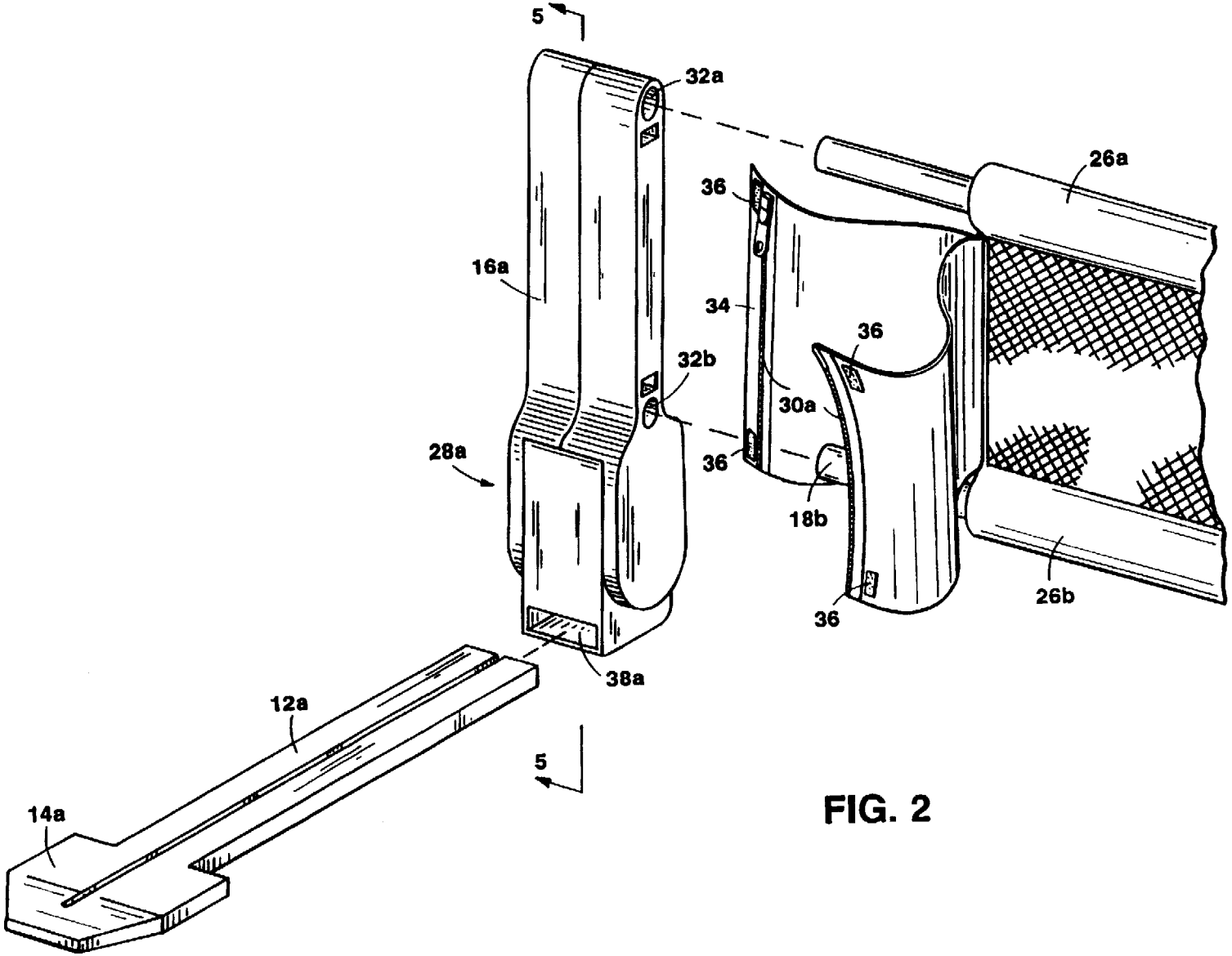
FIG. 2 is a partial exploded perspective view illustrating assembly of the bed rail of FIG. 1, with the cover partially opened.

As shown in FIG. 2, end portion 24*a* includes a zipper 30*a* allowing end portion 24*a* to be opened and removed from vertical member 16*a*. Similarly, end portion 24*b* also includes a zipper (not shown) and can be opened and removed in the same manner. When the end portions are opened, horizontal rails 18*a*, 18*b* may be removed from apertures 32*a*, 32*b* in vertical members 16*a* and 16*b* and the side panel 15 thus disassembled. The horizontal rails can also be removed, by sliding, from pockets 26*a*, 26*b* so that the cloth cover may be folded for transport, or removed and washed.

Figure 3:
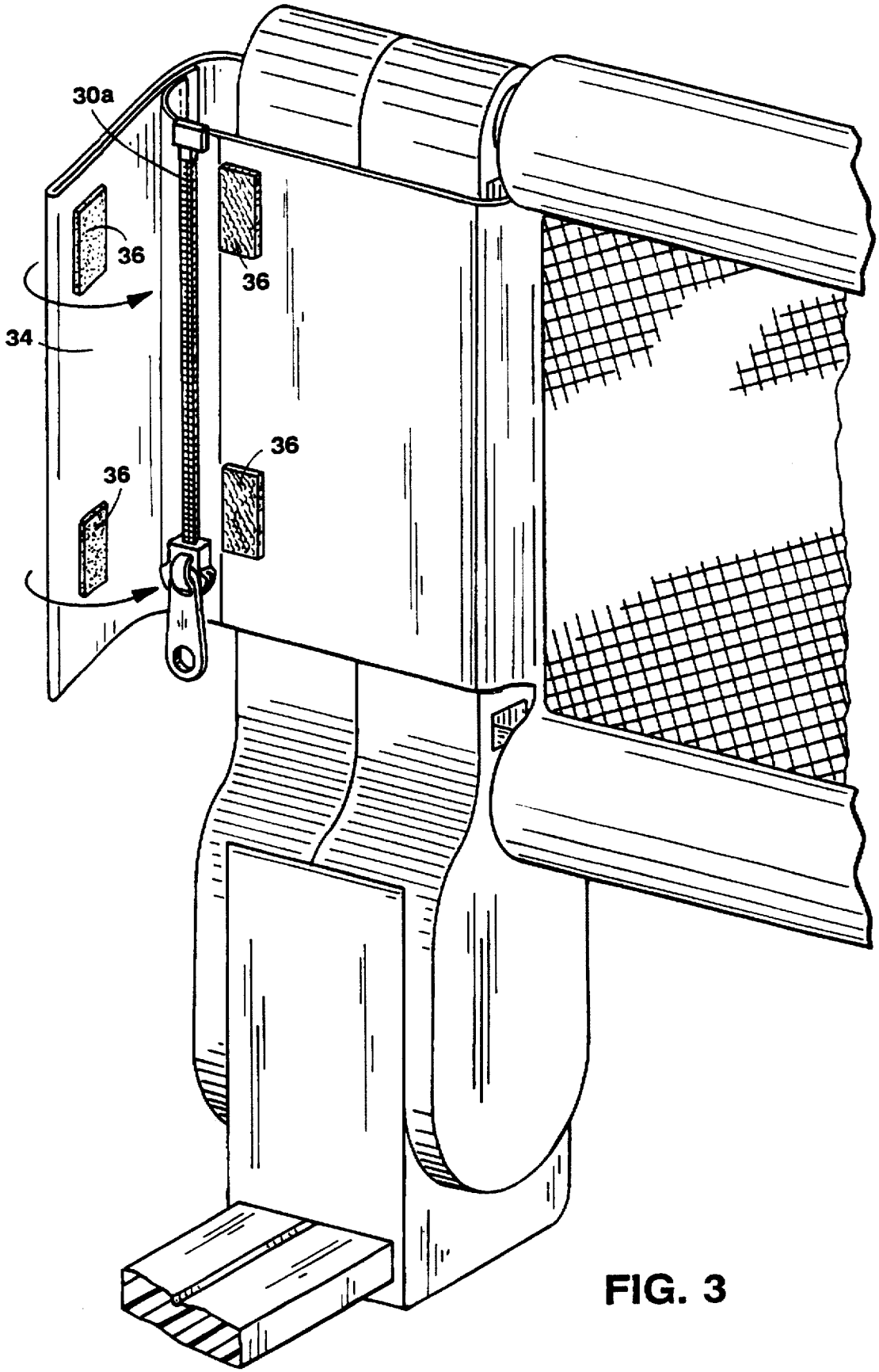
FIG. 3 is a detailed partial perspective view of the left-hand portion of FIG. 1.

As shown in detail in FIG. 3, each of the end portions 24*a*, 24*b* preferably further includes a flap 34 and hook and loop fasteners 36. During assembly of the bed rail, flap 34 is folded over zippers 30*a*, 30*b* (arrows) and hook and loop fasteners 36 are fastened, so that flap 34 covers zippers 30*a*, 30*b* to deter a child from unzipping them and to give the cloth cover a neat appearance.

Preferably, horizontal rails 18*a*, 18*b* are each comprised of two interlocking portions (not shown) that engage each other by, e.g., a telescoping press fit of a swaged end of one portion into a non-swaged end of the other portion (a portion of cover 20 is cut-away in FIG. 1 to schematically show this interlocking engagement). The portions preferably interlock in a manner that is easily disengaged during disassembly of the bed rail.

Figure 4:
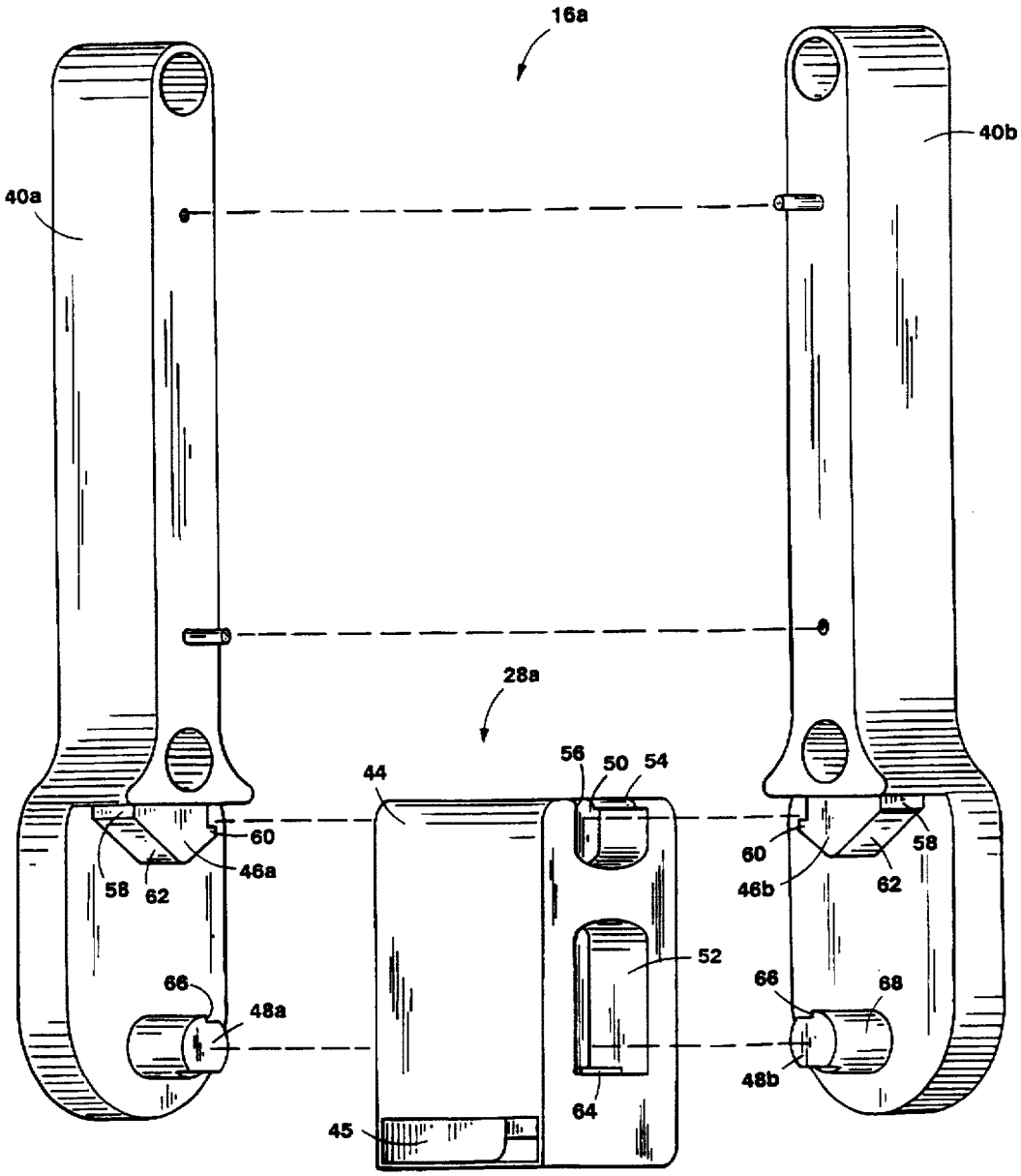
FIG. 4 is an exploded perspective view of a pivotable coupling assembly for joining the vertical panel and horizontal foot members according to one embodiment of the invention. Members 40*a* and 44 are oriented so that their right sides are fully visible, while member 40*b* is oriented so that its left side is fully visible.
Figure 5:
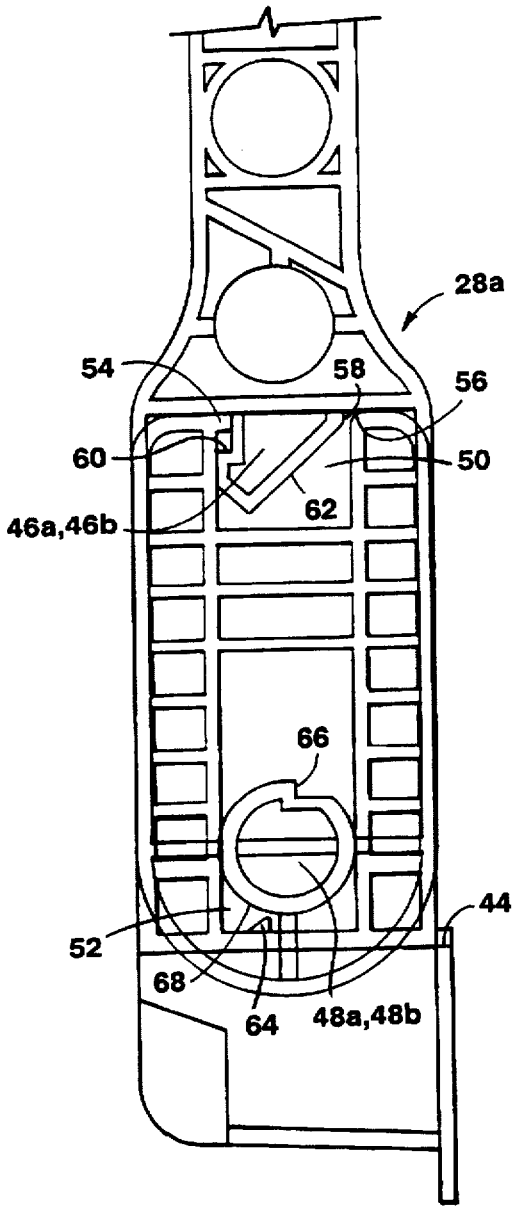
FIGS. 5–5C are cross-sectional views of the pivotable coupling shown in FIG. 2, taken along line 5—5 of FIG. 2, showing the vertical member in its raised locked position (FIG. 5), its lowered locked position (FIG. 5C) and intermediate positions (FIGS. 5A and 5B).
Figure 5A:
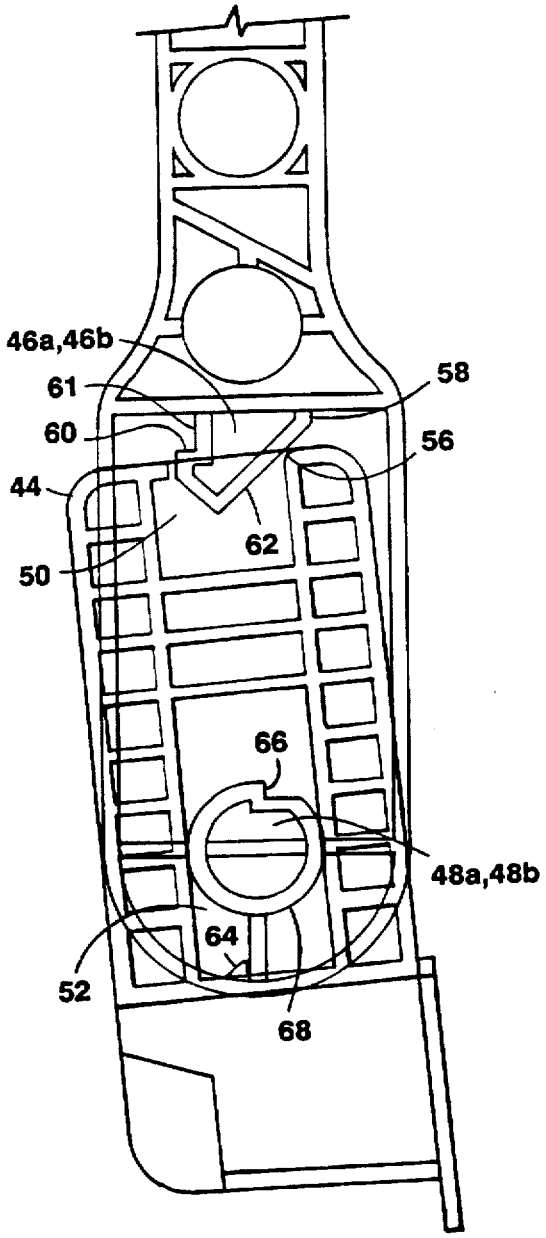
Figure 5B:
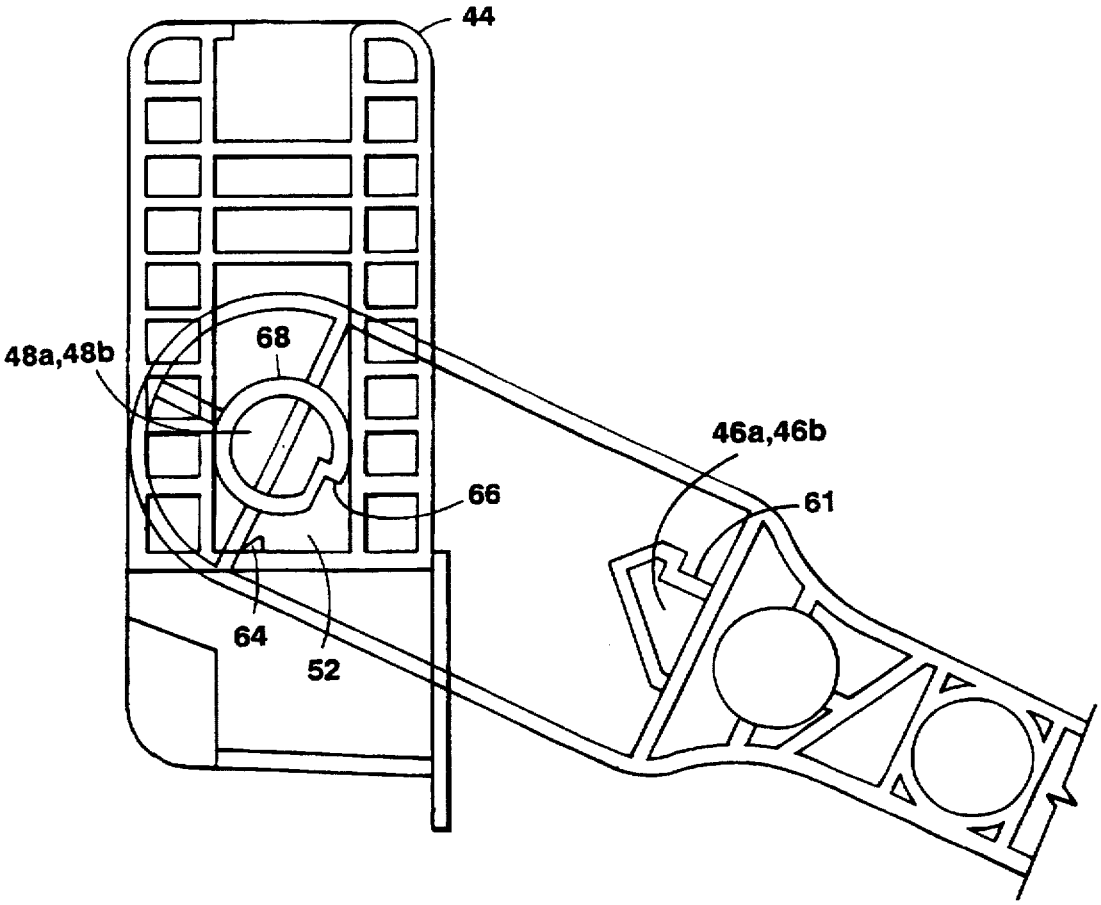
Figure 5C:
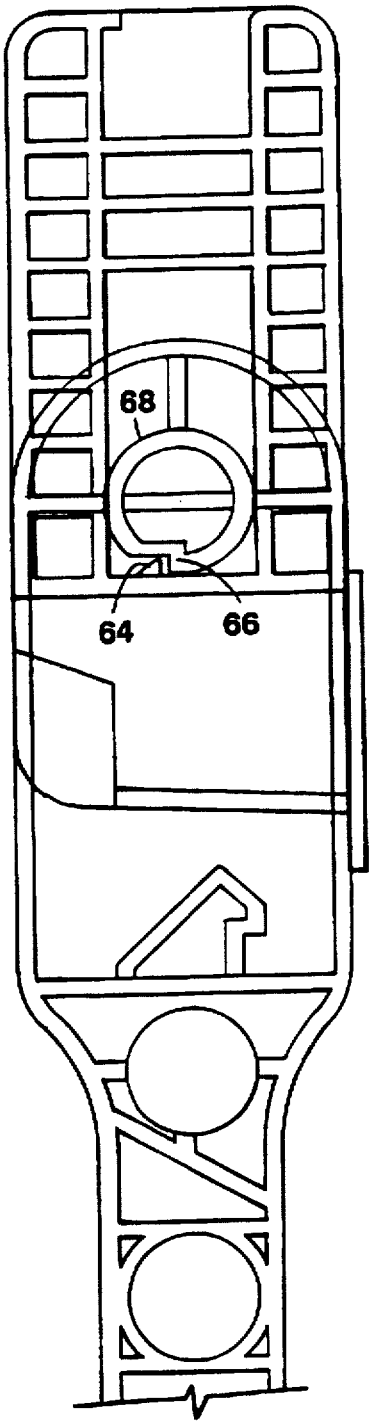

Preferably, as shown in FIGS. 4 and 5–5*c*, the pivotable couplings 28*a*, 28*b* each include a stationary coupling member 44 having a cavity 45 which receives an end of the foot member 12. Preferably the foot member is permanently mounted in cavity 45, e.g., by heat or ultrasonic welding. Whether permanently or removably mounted, the foot member is snugly press-fit into the cavity.

Each vertical member 16*a*, 16*b* is formed of two elongate portions 40*a*, 40*b*. Each portion includes a first latch member 46*a*/46*b* and a second latch member 48*a*/48*b*. The first and second latch members are dimensioned to be received by, respectively, a recess 50 at the top of the coupling member 44, and a cavity 52 extending through a central region of the coupling member 44.

The first latch members and the recess into which they are received provide an interlocking engagement which allows the bed rail to be securely locked in its raised position. Recess 50 includes a lip 54 extending along one of its longitudinal edges, the opposite edge 56 being smooth. First latch members 46*a*/46*b* include a vertical wall 58 and a second vertical wall 61, the walls being constructed to define an opening substantially equal to the width of recess 50 (see FIG. 5), so that the latch member 46*a*/46*b* engages the opening of recess 50 in an interference fit when the side panel is in its raised position (see FIG. 5), the interference fit being disengageable by moving the side panel directly upward. Second vertical wall 61 terminates in a shoulder 60 positioned to engage the lip 54 when the raised vertical member is pulled directly upward, preventing rotation of the vertical member. The first latch members also include an inclined surface 62 positioned and dimensioned so that the width of the latch members tapers to allow the shoulder 60 to be disengaged from the lip 54 by pulling outward on the vertical member to slide the inclined surface over the smooth edge 56 of the recess 50 (see FIG. 5*a*). The vertical member can then be freely rotated from its raised position toward its lowered position (see FIG. 5*b*).

Once the bed rail reaches its lowered position (FIG. 5*c*) it is again locked in place, in this case by interlocking engagement of the second latch members 48*a*/48*b* with the cavity 52 into which they are received. Cavity 52 includes a stop 64 positioned at the lowest extremity of cavity 52, and second latch members 48*a*/48*b* include a shoulder 66 dimensioned to engage the stop when the vertical member is in its lowered position (FIG. 5*c*) to resist rotation toward the raised position. The engagement of the stop with the shoulder is disengageable by moving the vertical member upward relative to the coupling member, and the smooth cylindrical surface 68 of latch members 48*a*/48*b* allows the vertical member to be rotated about the longitudinal axis of the second latch member, to its raised position, when the shoulder and stop are disengaged.

The cloth cover 20, with the exception of mesh portion 22, can be formed of any desired flexible material, e.g., woven or non-woven fabric or flexible plastic sheet material. A preferred material is a polyester/cotton blend. The mesh portion 22 may be formed of any desired mesh material, as is well known in the children's furniture art. A preferred mesh material is nylon mesh. The other components of the bed rail may be formed of any rigid material suitable for use in children's furniture. It is generally preferred that the horizontal rails be formed of metal and the other components of injection molded plastic.

Other embodiments are within the claims. For example, while the horizontal rails and apertures which receive them have been shown as having a round cross-section, they could have a different shape, e.g., a square cross-section, if desired. Further, the cloth cover of the invention could be used with other types of bed rail assemblies, e.g., bed rails which do not include a pivotable coupling, and the pivotable coupling could also be used with other types of bed rails, e.g., bed rails which do not include the cloth cover of the invention. Moreover, while the foot members have been described as being press-fit into the coupling member, they could instead be molded integral with the coupling member.

What is claimed is:

1. A portable bed rail for use with a bed, comprising:

first and second foot members, each having a first end dimensioned for insertion under a mattress and a second end spaced from said first end; and a side panel, positioned to provide a barrier to falling from the bed, comprising first and second vertical members extending upwardly from said second ends of said first and second foot members, first and second spaced horizontal rails extending between said vertical members to define a frame, said first and second horizontal rails each having first and second ends which are received by said first and second vertical members; and a flexible cover removably mounted on said frame and dimensioned to extend around said first and second ends of said horizontal rails in a manner to retain said first and second ends of said horizontal rails in engagement with said first and second vertical members.

2. The portable bed rail of claim 1 wherein said flexible cover comprises first and second elongated pockets dimensioned to receive said first and second horizontal rails.

3. The portable bed rail of claim 2 wherein said flexible cover further comprises first and second end portions positioned at opposite ends of said elongated pockets, each end portion comprising a pair of flaps dimensioned to surround said vertical member and retain said ends of said horizontal rails in engagement with said vertical member, and a fastener positioned to fasten each said flaps in position surrounding said vertical member.

4. The portable bed rail of claim 3 wherein each horizontal rail comprises-two portions, each portion having a first end corresponding to said first and second ends of said horizontal rail and a second end dimensioned for telescopic functional engagement with said second end of the other portion.

5. The portable bed rail of claim 4 wherein said flexible cover further comprises a central mesh portion.

6. The portable bed rail of claim 1 wherein said first and second ends of said horizontal rails are removably received by apertures in said vertical members.

7. The portable bed rail of claim 1 wherein said vertical members are pivotally mounted on said foot members.

8. A portable bed rail comprising first and second foot members, each having a first end dimensioned for insertion under a mattress and a second end spaced from said first end, a side panel positioned to provide a barrier from falling from the bed, said side panel including first and second vertical members extending from said second ends of said foot members, and a pair of pivotable couplings, one pivotable coupling being interposed between one end of said first vertical member and said second end of said first foot member from which said vertical member extends, and the other pivotable coupling being interposed between one end of said second vertical member and said second end of said second foot member from which said vertical member extends, each pivotable coupling being constructed to allow the corresponding vertical member to be rotated between a raised position, in which it extends upwardly substantially perpendicular to said foot member, and a lowered position, in which it extends downwardly substantially perpendicular to said foot member, and each pivotal coupling including first interlocking portions that engage when said vertical members are in said raised position and second interlocking portions that engage when said vertical members are in said lowered position, whereby said vertical members are adapted to be locked in each of their raised and lowered positions.

9. The portable bed rail of claim 8 wherein said pivotable coupling includes a stationary coupling member from which said foot member extends in a manner to resist movement of said foot member with respect to said coupling member.

10. The portable bed rail of claim 8 wherein each of said first and second interlocking portions are constructed to be disengaged only by movement of said vertical member in a direction other than rotation.

11. The portable bed rail of claim 10 wherein said first interlocking portions are disengaged only by combined upward and outward movement.

12. The portable bed rail of claim 10 wherein said second interlocking portions are disengaged only by upward movement.

13. The portable bed rail of claim 10 wherein said first interlocking portions comprise (a) a recess in an upper surface of said coupling member, said recess having a lip extending along one of its longitudinal edges, the opposite edge being smooth, and (b) a latch member on said vertical member dimensioned to be received by said recess and having a portion dimensioned to engage the opening of said recess in an interference fit when said vertical member is in its raised position.

14. The portable bed rail of claim 13 wherein said interference fit is disengageable by moving said vertical member directly upward, and said vertical member includes a shoulder positioned to engage said lip when said raised vertical member is pulled directly upward, and an inclined surface positioned and dimensioned to allow said shoulder to be disengaged from said lip by pulling outward on said vertical member to slide said inclined surface over the smooth edge of said recess.

15. The portable bed rail of claim 10 wherein said second interlocking portions comprise (a) a cavity in said coupling member dimensioned to receive a second latch member on said vertical member, said cavity including a stop, and (b) a second latch member on said vertical member having a shoulder dimensioned to engage said stop when said vertical member is in its lowered position, to resist rotation toward said raised position.

16. The portable bed rail of claim 15 wherein the engagement of said shoulder with said stop is disengageable by moving said vertical member upward relative to said coupling member, and said second latch member and cavity are constructed to allow said vertical member to be rotated about the longitudinal axis of said second latch member when said shoulder and stop are disengaged.

* * * * *